US005232539A

United States Patent [19]

Carpenter et al.

[11] Patent Number: 5,232,539

[45] Date of Patent: Aug. 3, 1993

[54] OBJECT LABELING MACHINE

[75] Inventors: George F. Carpenter, Rockford; Jeffrey A. Engelsman, Hudsonville; Christopher Harris, Grand Rapids; Mark D. Salley, Alto, all of Mich.

[73] Assignee: Grand Rapids Label Company, Grand Rapids, Mich.

[21] Appl. No.: 660,142

[22] Filed: Feb. 22, 1991

[51] Int. Cl.[5] ..... G05G 15/00

[52] U.S. Cl. ..... 156/360; 156/361; 156/362; 156/363; 156/542

[58] Field of Search ..... 156/361, 362, 363, 540, 156/541, 542, 468, 566, 360

[56] References Cited

U.S. PATENT DOCUMENTS

| | | | |
|---|---|---|---|
| 3,024,557 | 3/1962 | Frenkel et al. | 156/542 |
| 3,093,528 | 6/1963 | Reich | 156/285 |
| 3,238,080 | 3/1966 | Schluter | 156/542 |
| 3,329,550 | 7/1967 | Kucheck | 156/285 |
| 3,427,214 | 2/1969 | Voigt | 156/363 |
| 3,489,638 | 1/1970 | Collons | 156/584 |
| 3,562,067 | 2/1971 | Kucheck | 156/542 |
| 3,729,362 | 4/1973 | French et al. | 156/542 |
| 3,806,395 | 9/1972 | French | 156/497 |
| 3,885,705 | 5/1975 | French | 156/497 |
| 3,888,725 | 6/1975 | French | 156/556 |
| 3,984,277 | 10/1976 | French et al. | 156/497 |
| 4,106,972 | 8/1978 | Caudill | 156/363 |
| 4,267,004 | 5/1981 | Anderson | 156/361 |
| 4,276,112 | 6/1981 | French et al. | 156/542 |
| 4,294,644 | 10/1981 | Anderson | 156/361 |
| 4,321,103 | 3/1982 | Lindstrom et al. | 156/566 |
| 4,366,023 | 12/1982 | Voltmer | 156/363 |
| 4,488,925 | 12/1984 | Craig et al. | 156/351 |
| 4,518,450 | 5/1985 | Warmann | 156/566 |
| 4,542,616 | 9/1985 | Ulrich et al. | 156/468 |
| 4,554,042 | 11/1985 | Marchetti | 156/468 |
| 4,561,921 | 12/1985 | Treiber | 156/542 |
| 4,574,027 | 3/1986 | Weinündbrot | 156/542 |
| 4,585,505 | 4/1986 | Matsuguchi | 156/361 |
| 4,585,506 | 4/1986 | Matsuguchi | 156/363 |
| 4,612,076 | 9/1986 | Moss | 156/249 |
| 4,758,303 | 7/1988 | Shastko | 156/542 |
| 4,769,110 | 9/1988 | Ohno et al. | 156/360 |
| 4,787,953 | 11/1988 | Trouteaud et al. | 156/542 |
| 4,799,981 | 1/1989 | Stone et al. | 156/541 |
| 4,830,701 | 5/1989 | Crankshaw et al. | 156/448 |
| 4,840,694 | 6/1989 | Brookman et al. | 156/541 |
| 4,844,771 | 7/1989 | Crankshaw et al. | 156/387 |
| 4,867,833 | 9/1989 | McCoy | 156/361 |
| 4,954,203 | 9/1990 | Matsumoto | 156/363 |

*Primary Examiner*—David A. Simmons
*Assistant Examiner*—W. J. Matney, Jr.

[57] ABSTRACT

A machine for applying labels to products of various sizes employs a movable printer/applicator head. Control circuitry responsive to sensors located along a conveyor by which the products are moved toward the machine generates output signals to an electrical motor which drives the printer/applicator head at a speed defined by the processor output signals. Labels to be printed are supplied to the head from a label supply strip wound on a label supply reel mounted on the stationary part of the machine. The portion of the strip extending between the reel and the head is provided with a loop to assure sufficient length of the strip for free movement by the head. The strip is lengthened by an amount less than the length of a label each time a label is removed and is lengthened by an additional amount each time a short-loop condition is detected. A pick plate assembly for removing unwanted labels is maintained in a retracted position along one side of the head when not in use, in order to avoid interference with the products to be labeled.

29 Claims, 13 Drawing Sheets

OBJECT LABELING MACHINE

BACKGROUND OF THE INVENTION

1. Field of the Invention

The invention pertains to apparatus for applying labels or the like to objects and more particularly to automated machinery for applying labels or the like to objects of different dimensions on a continuously moving conveyor.

2. Prior Art

Automated machinery is known which applies imprinted labels to packages moving along a conveyor belt. Typically, labels are supplied on an elongated backing strip which may be retained on a reel. The labels are removed from the backing strip by the applicator machinery and retained against a grid by means of vacuum. When a package is aligned with the head, an air blast transfers the label from the grid to the package to be labeled. One such prior art arrangement is shown, for example, in U.S. Pat. No. 3,885,705, issued May 27, 1975.

Using an air blast to apply a label to a package requires that the applicator be in relatively close proximity to a surface of the package, typically the top surface. When packages of, for example, different heights are to be labeled, it is necessary to adjust the relative distance between the applicator and the top surface of the package for the various packages. Preferably, this will be done automatically as packages of different heights are moved past an applicator machine on a conveyor. In one prior art arrangement, disclosed in U.S. Pat. No. 3,729,362, issued Apr. 24, 1973, an applicator pad has a cluster of vertically extending fingers which engage a label deposited on the pad and transfer the label to an object in alignment with the applicator pad. One clear disadvantage of such an arrangement is that only a limited height difference between products can be accommodated. Furthermore, such an arrangement is inherently relatively slow since the fingers must be retracted before the next label can be deposited onto the applicator pad for application to a subsequently arriving product.

It is a general problem of the prior art to produce label application machinery that can handle products of greatly varying dimensions on a relatively rapidly moving conveyor with a limited distance between products. Preferably, the time between application of labels on successively appearing products of different heights will be less than 500 milliseconds. Such an arrangement requires very rapidly adjustable applicators. It has long been proposed to move an applicator head on a stationary support structure, by means of a linear stepper motor in which a moving element is moved along a longitudinally extending platen. A drawback of such devices is that they are particularly adapted for high-speed, low-mass applications, while the mass of the label applicator head is substantial.

When labels are applied to products by a blast of air, it is common to provide a secondary impression roller to press the label against the product and provide a secondary wipe-down effect on the label. Prior art label applying apparatus which makes adjustments for varying heights of products to be labeled do not provide such a secondary impression roller, thereby providing a less reliable adhesion of the labels.

It is well known that occasionally a label applying machine, for one reason or another, does not deposit a label on the product for which it was intended. Since such labels are generally individually printed for the products as they are conveyed to the applicator machine, an unused label must be removed to avoid mislabeling a subsequently arriving product. To this end, a device known as a pick plate is temporarily aligned with the applicator and the standard air blast is used to deposit the label onto the pick plate. Typically, such a pick plate extends below the applicator head and occasionally snags a product. In a system using a height adjustable applicator, severe damage to the product may result as well as damage to the equipment.

SUMMARY OF THE INVENTION

These and other problems of the prior art are overcome in accordance with the principles of this invention by providing a product labeling machine with a movable head assembly which incorporates a label applicator mechanism. As products of different sizes approach the labeling machine, the head is appropriately positioned a predetermined distance above the top surface of the product and the label is applied in a conventional manner. In accordance with a specific embodiment of the invention, the applicator head is mounted on a support carriage attached to a drive belt and an electric motor drives the belt to position the applicator head at various elevations as required to perform the label application function. Control circuitry is provided which is responsive to a height sensor to operate the motor to move the applicator head to a desired height position in sufficient time to apply a label to each of a plurality of products of varying heights. In one specific embodiment, the applicator head supporting carriage slidably engages a pair of parallel vertically extending support rods. Advantageously, such an arrangement allows for ease of movement in the vertical direction and readily supports the weight of the applicator head in the proper orientation at all elevations. The support carriage may be securely attached to the drive belt in order to avoid slippage, and the drive belt may further be provided with a ridged inner surface to assure exact linear displacement for each rotational movement of the motor drive pulley.

In accordance with one aspect of the invention, the applicator head includes a secondary impression roller which performs a standard label impressing and wiping function for each label that is applied.

In accordance with one aspect of the invention, a pick plate assembly is incorporated in the moving head assembly. A pick plate assembly in accordance with this invention has a retracted position along one side of the head out of the path of any product to be labeled. Advantageously, this avoids occasional snagging experienced in prior art arrangements. In accordance with this invention, a pick plate is pivotally attached to one side of the applicator head, and an actuating cylinder pivotally attached to the applicator head and to the pick plate is operative to move the pick plate into an appropriate position below the head for receiving an unwanted label.

In accordance with another aspect of this invention, labels are removed from an elongated label strip which is fed from a reel attached to the stationary part of the labeling machine. Advantageously, this provides an immediate supply of labels at the applicator head but does not require that a reel be moved when the head is moved.

In accordance with one particular aspect of the invention, a loop of label strip is maintained between the reel and the applicator head and the reel is advanced a certain distance less than that required for the application of an additional label, each time a label is used. Furthermore, a detector is provided to detect when the loop has been shortened beyond a certain length and the machine automatically advances the reel to lengthen the loop by only a specified amount. Advantageously, in accordance with this invention, an unnecessary extension of the label strip, which could cause snagging as the head is moved, is avoided. Similarly, a shortening of the label supply strip which could cause damage when the head is moved, is avoided.

BRIEF DESCRIPTION OF THE DRAWING

An illustrative embodiment of the invention is described below with reference to the drawing in which.

DETAILED DESCRIPTION

Figure 1:
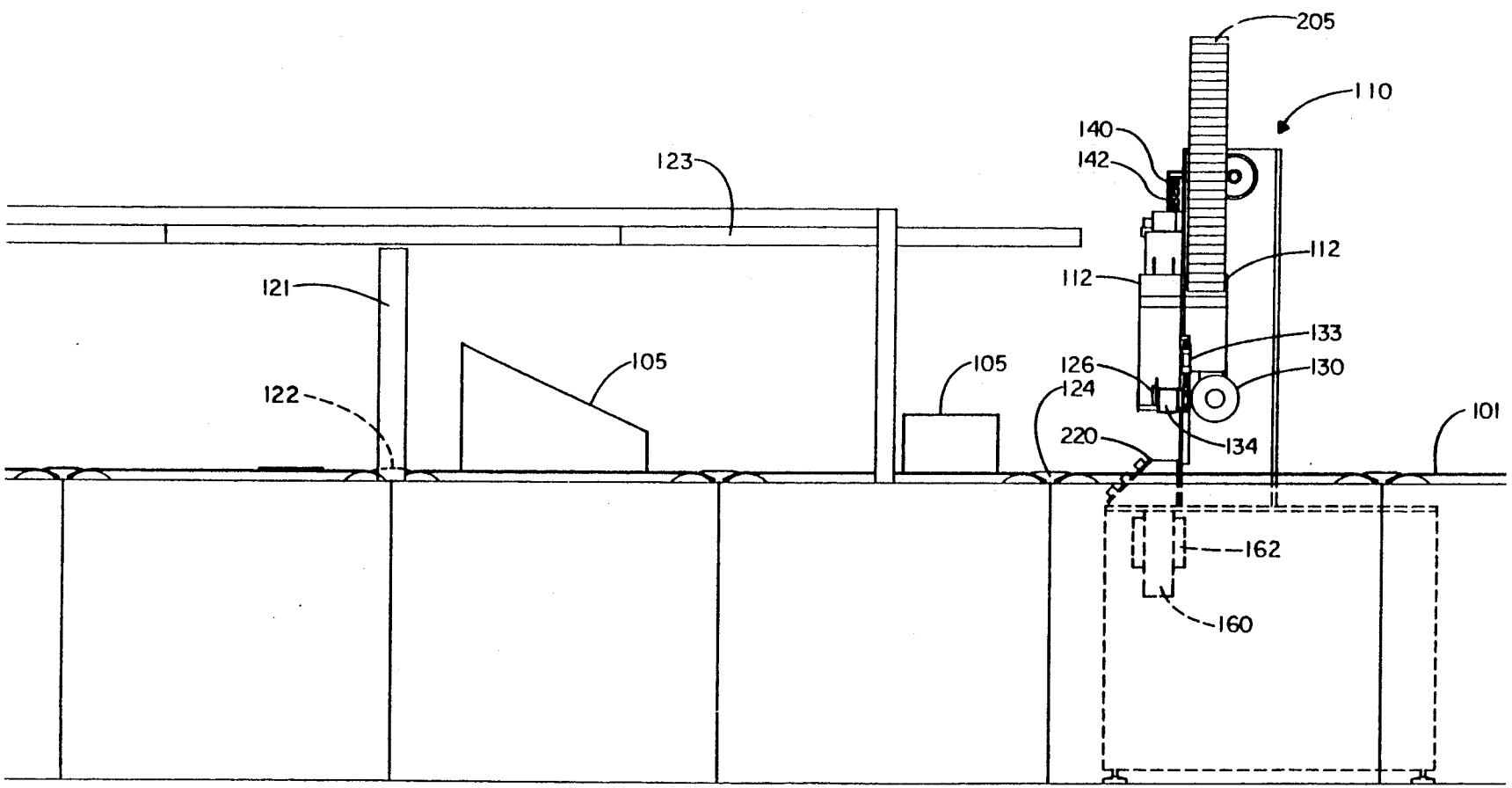
FIG. 1 is a frontal elevation of a product labeling apparatus incorporating the principles of this invention.

Shown in FIG. 1 is a label application system including a conveyor 101 and a label applying machine 110. The label applying machine 110 comprises a movable label printer/applicator head 112 which, under control of circuitry within the machine 110, prints labels and applies the labels to objects such as product 105 traveling on the conveyor 101 in the direction indicated by the arrow. Printer/applicator heads are well known in the art and are commercially available and may, for example, be a SATO, Model 4500S label printer/applicator. A plurality of electro-optical sensors 121, 122, 124 are positioned along the conveyor and provide information from which profile data of an arriving product can be computed. This data is used by the label application machine 110 to position the printer/applicator head 112 at the proper height and to apply a label at an appropriate location on the product. Sensor 121 is a standard optical array of emitters and detectors arranged in a vertically extending line and provide object height information. Sensor 122, referred to as transfer plate 1, and sensor 124, referred to as transfer plate 2, provide product presence information. They are standard optical linear array detectors which receive illumination from a source 123 and are positioned in alignment with the conveyor, which may be a standard roller conveyor. A sensor 126 on the printer/applicator head 112 is used to detect whether the object is positioned in alignment with the head before the label is applied. The label is applied to the product by means of air pressure which forces the label onto the box and the label is further pressed onto the surface of the box by means of an impresser roller 130 preferably made of a compressible foam construction. A pick plate 134 is provided to receive an unwanted label in the event that a product is missed and not in alignment with the head 112 for proper label application. A pneumatically operated pick plate actuator assembly 133 moves the pick plate 134 in alignment with the label applicator 136 to allow the unwanted label to be deposited on the pick plate and removed. The pick plate 134 is shown in the retracted position in FIG. 1.

Figure 2:
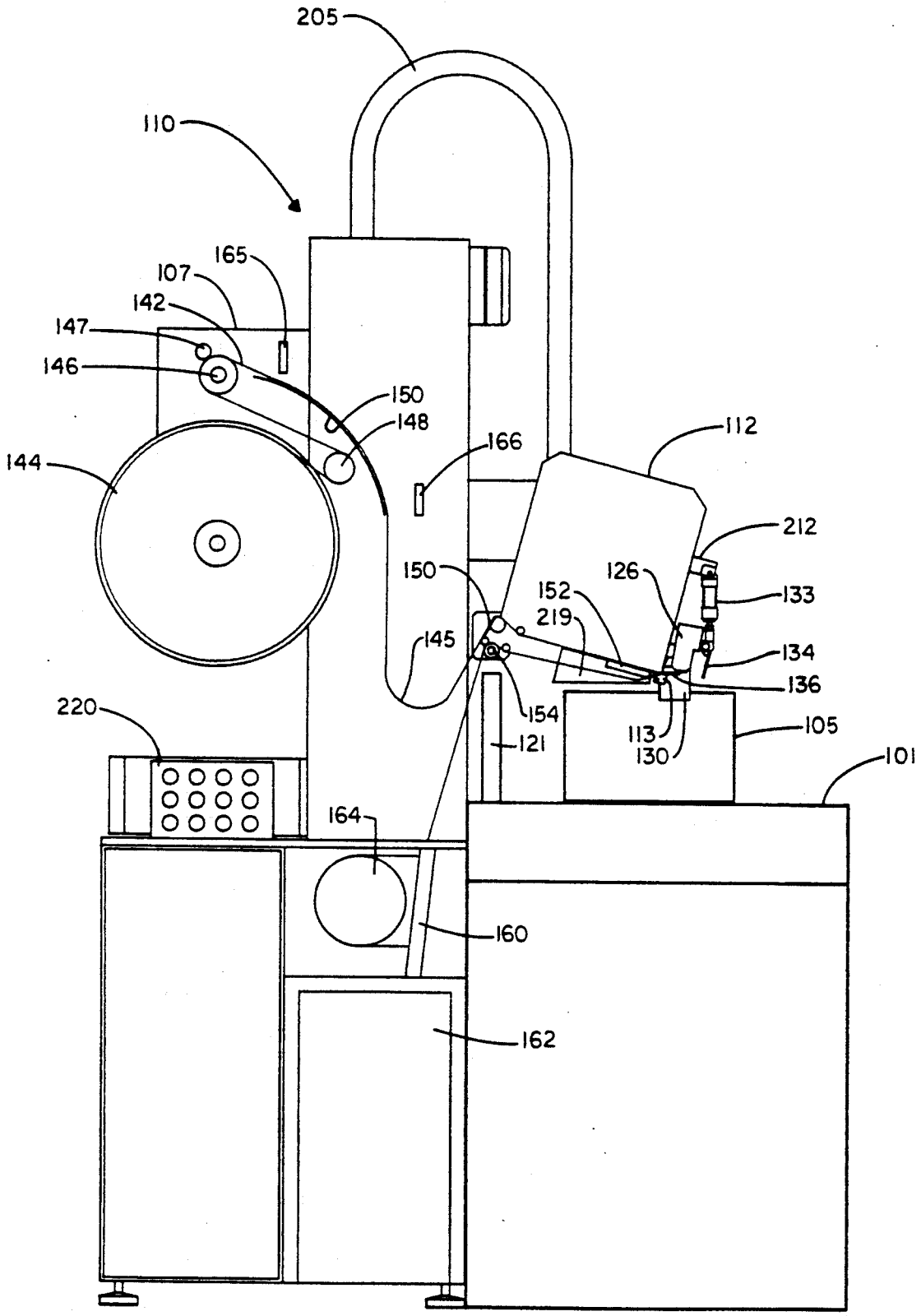
FIGS. 2 and 3 are side elevations of the apparatus of FIG. 1.

FIG. 2 is a right side elevation of the system of FIG. 1 showing a label supply arrangement by which blank labels to be printed are supplied to the printer/applicator head 112. Blank labels 140 (shown in FIG. 1) are transported to the head 112 via a label supply strip or web 142 which is stored on a supply reel 144. The web 142 is dispensed from the reel 144 by means of a drive roller 146 in cooperation with idler rollers 147 and 148. The web 142 is guided to the head 112 via a plurality of strip guides 150 and advanced over a peeler bar 152 in a standard fashion. The web is drawn over the peeler bar by means of a powered rewind assembly 154, and the labels 140 are removed from the label web 142 in a conventional manner. The applicator pad 136 is a standard pad provided with a plurality of openings, and a pressure below atmospheric pressure is created behind the applicator pad to cause a label to be retained on the pad. Typically, the printer/applicator head incorporates a printing mechanism which imprints the label with address information provided to the printer for each label. The label is transferred from the applicator pad 136 to the product 105 by a blast of air of a pressure considerably higher than atmospheric pressure. The label web, from which labels have been removed, is guided into a vacuum chute 160 and into a label web receptacle 162 by means of a vacuum created by electric motor 164 in a standard fashion. The receptacle may be provided with a shredder in order to reduce the bulk of the label web.

An electro-optic sensor 165, with its optical opening directed toward web 142, senses the presence of the label supply web 142 and creates an appropriate warning signal when the label supply is not present. The web 142 extends from reel 144 mounted on a stationary housing 107 to the head 112 which is movable over a range of positions between upper and lower limits. A loop section 145 is maintained in web 142 to provide sufficient slack to allow for travel by head 112 over its full range without tension on the web. A standard electro-optical sensor 166, which, like sensor 165, has its optical opening directed downwardly, senses when the loop section 145 of the web 142 comes within close proximity of the sensor. When such a condition is sensed, an appropriate signal is generated and transmitted to control circuitry internal to the label applying machine 110 and the loop is lengthened by a predetermined amount. Control of the loop section 145 of the web 142 is critical, since if the loop is too short, labels will not be appropriately fed, and if the loop is too long, it may become entangled with parts of the machine. Such control includes advancing the web 142 somewhat less than the length of a single label, e.g., 90% of a label length, each time a label is removed. This serves to continually shorten the loop section 145. When the loop section 145 is shortened to the extent that the presence of the loop section is detected by sensor 166, the web 142 is advanced by a predetermined amount, e.g., the amount equivalent to two labels. In this manner, the loop is maintained within limits to avoid overextending the loop or shortening the loop too much. In the present illustrative system, the sensor 166 will preferably be positioned such that a foreshortened loop is detected when the head 112 is at or near its upper limit. The exact position of the sensor 166 will therefore depend upon the limits of travel of the head 112 as well as the sensitivity of the sensor itself. The reel 144 is driven by a motor shown in the drawing within housing 107. The reel 144 and its motor are well-known and commercially available devices. Operation of the motor is controlled from an unwind drive motor relay 245, shown in FIG. 7, and is operated by control circuitry internal to machine 110 to advance the motor each time a label is used either by the standard amount (e.g., 90% of label length) or the standard amount plus the predefined additional amount (e.g., two label lengths). Activating the motor only when a label is used prevents the reel from unwinding continually in case of a malfunction of the sensor 166.

Figure 3:
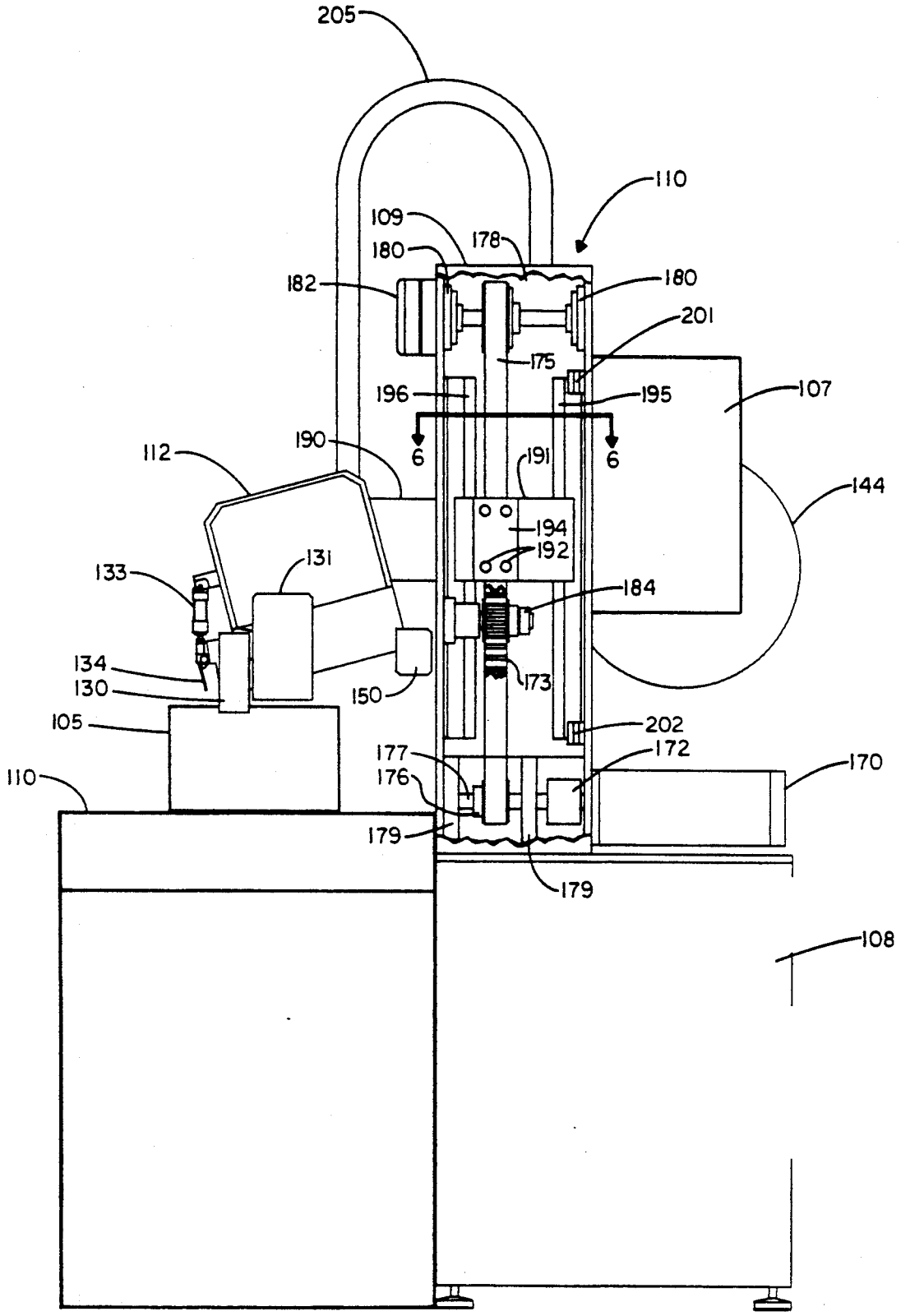
Figure 6:
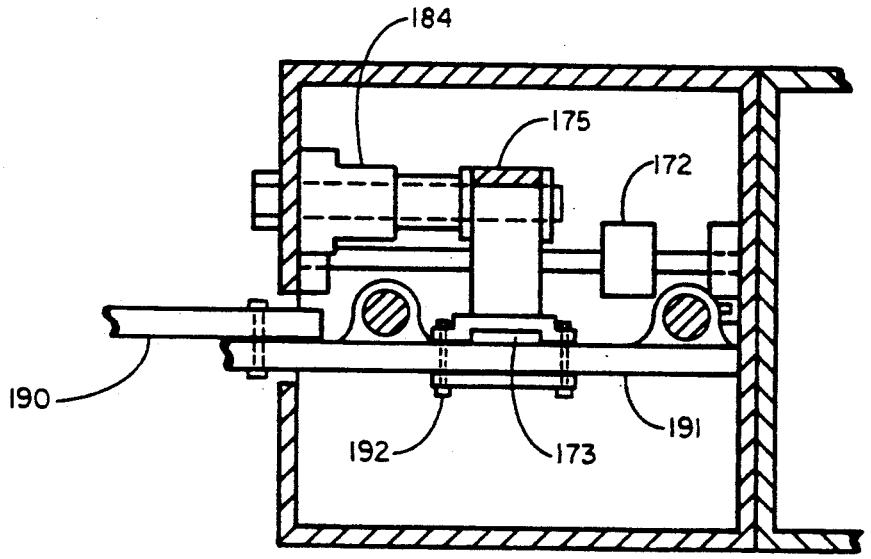
FIG. 6 is a cross-sectional view along line 6—6 of FIG. 3.

FIG. 3 is a partial, fragmentary left side elevation showing the drive mechanism for raising and lowering the printer/applicator head 112. FIG. 3 shows an electric drive motor 170 which is a servomotor of a well-known type and may, for example, be a Compumotor, Model KHX730 motor assembly. The servomotor is adapted to turn in either direction at various speeds and is used to raise and lower the head 112 at a rate of speed which is dependent upon the magnitude of change in position required between products on the conveyor, the distance between objects as well as the rate of travel of objects on the conveyor 101. The time for adjustment between different positions on a relatively high-speed conveyor belt moving at, for example, 360 feet per minute and carrying closely spaced objects, allows a relatively short time period, e.g., less than 500 milliseconds, to reposition the head. Rapid movement of the head between relatively precise positions is attained by means of a tangential drive employing a belt 175 driven by means of a drive pulley 176 connected to servomotor 170 by means of a standard shaft coupler 172. To assure positive displacement, the drive pulley 176 may be provided with teeth engaging a corresponding set of teeth 173 on the inner surface of the belt, shown in cutaway in FIG. 3, in the same fashion as what is commonly known as a timing belt. The belt 175 extends over a driven pulley 178. The drive pulley 176 engages a shaft 177 retained in well-known bearing cages 179. Similarly, the driven pulley 178 is supported on a shaft engaging standard bearing assemblies 180. A known drive brake 182 is provided to allow for immediate stops in case of an error condition in order to avoid damage to the equipment or products. The belt 175, which may for example be made of a Kevlar cord construction which allows for the force of high acceleration and deceleration, extends over a tensioner pulley 184 which may be adjusted in a standard fashion to assure appropriate tension on the belt 175. The head 112 is attached to a support bar 190, which attaches to a carriage 191. Carriage 191 engages belt 175 by means of a clamp 194 securely fastening the carriage to the belt. Fasteners 192 are used to attach the clamp 194 to the carriage. FIG. 6 is a cross-sectional view along line 6—6 of FIG. 3 and shows clamp 194 engaging teeth 173 of belt 175 to assure slip-free engagement between the belt 175 and the carriage 191. The carriage 191 slidably engages vertically extending linear ways 195 and 196, which are attached to housing 109 in a standard fashion. The engagement with the linear ways assures proper alignment of the carriage 191 as the carriage is moved up or down along its path of travel. An upper limit switch 201 and a lower limit switch 202 are provided which are activated when reached by the carriage 191.

Lower housing 108 contains control circuitry for controlling the vertical positioning of the head as well as operations taking place within the head. Electrical cabling required for signaling the various functions are not shown in the drawing. Such cabling extends from the lower housing 108 into and through the upper housing 109 and via a commercially available, flexible carrier assembly 205 known as an E-chain. In addition to electrical cabling, the E-chain carries pneumatic tubing to provide both vacuum and air pressure to the head as required, for example, for label application and operation of the pneumatic cylinder of the pick plate assembly. The various control circuits contained within the lower housing 108 are shown in block diagram form in FIG. 7. Compressed air and vacuum may be provided to the label applicating machine 110, for example, at the rear housing 107, and solenoids for the application of vacuum or air may be contained at various locations in the machine 101. In order to assure timely action, the solenoid for controlling an air blast to blow a label from the applicator head onto the object may be located on the head or, for example, on support bracket 190 in relatively close proximity to the applicator plate to reduce delays.

Figure 4:
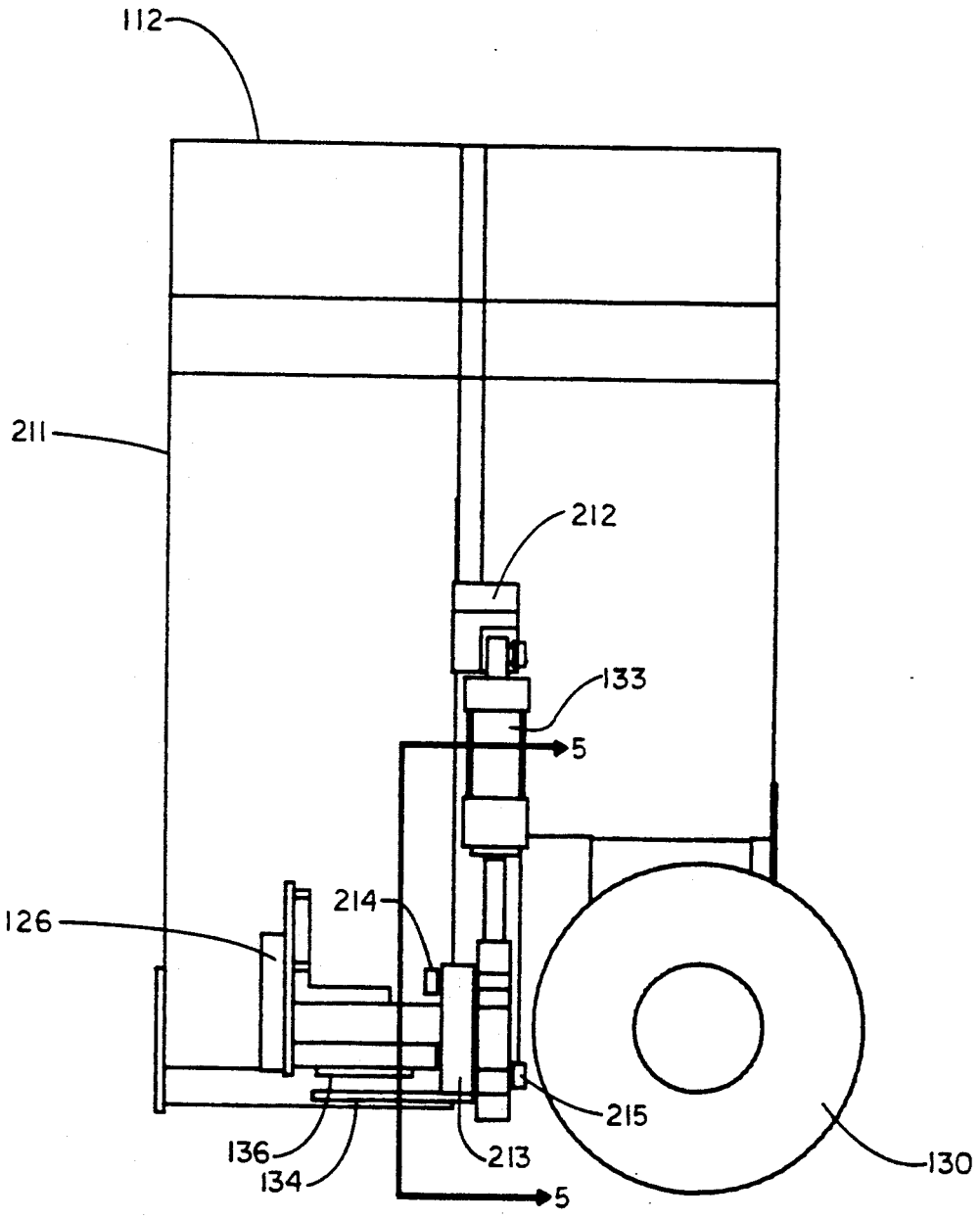
FIG. 4 is a frontal view of a label printer/applicator head incorporated in FIG. 1.
Figure 5:
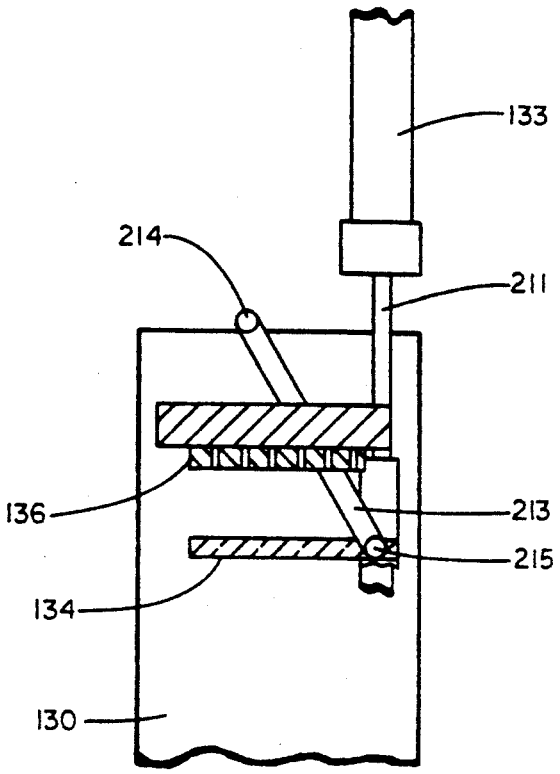
FIG. 5 is a cross section along line 5—5 of FIG. 4.

FIG. 4 is an enlarged front elevation of the head 112 showing the pick plate 134 in the down position in which it is ready to receive an unwanted label from the applicator pad 136. The pick plate actuator assembly includes a pneumatic cylinder 133 which is pivotally attached by means of bracket 212 to the housing 211 of the head 112. The pick plate 134 is attached to a support arm 213 which is pivotally attached by means of a pivot pin 214 to housing 211. As the pneumatic cylinder 133 is actuated to the retracted position, the support arm 213 is pivoted about pivot rod 214 to remove the pick plate 134 to the retracted position as shown in FIGS. 1 through 3. FIG. 5 is a partial fragmentary cross section along line 5—5 of FIG. 4 showing an angular relationship between the support bar 213 and the pick plate 134 as well as a pivot pin 215 for pivotally attaching rod 211 of the pneumatic cylinder 133 to the support bar 213. It will be appreciated that as cylinder rod 211 is retracted, the support bar 213 is pivoted upwardly causing the pick plate 134 to be removed to a position as shown, for example, in FIG. 2.

Figure 7:
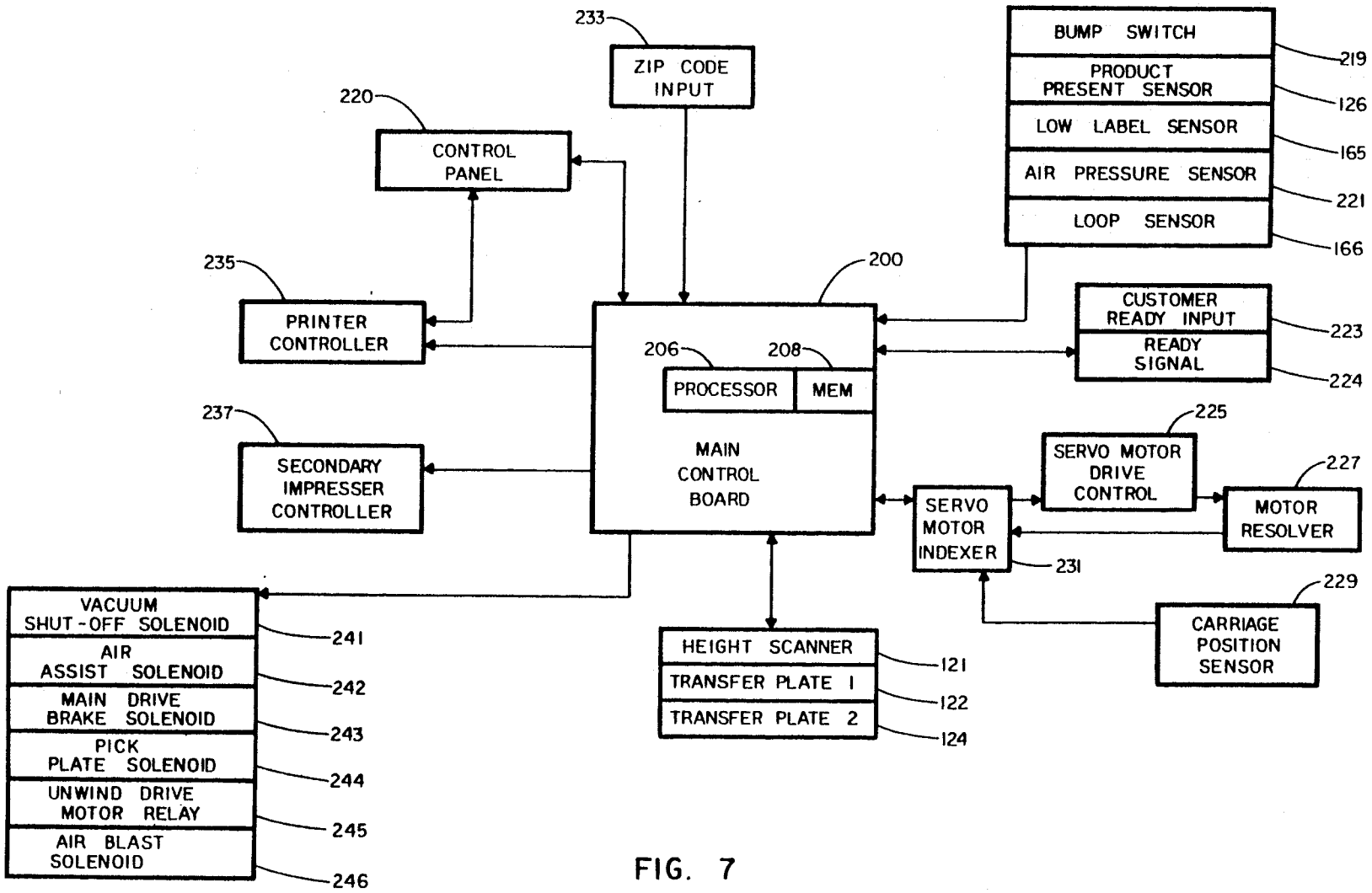
FIG. 7 is a block diagram representation of electrical control circuitry for controlling operations of the apparatus of FIG. 1.

FIG. 7 is a block diagram representation of circuitry for controlling the various operational functions of the label applying machine 110. The circuitry includes a main control board 200 incorporating a processor 206 and a memory 208 for storing programs and data for use by the processor 206. The control board 200 will further include a plurality of power and timing circuitry and input/output ports (not shown in the drawing) which provide an interface between the various system devices such as sensors, solenoids, and the like, and the processor 206. The processor 206 may be any of a number of commercially available processors; for example, an Intel 8031 processor, may be used. Sequencing of the various operations of the label applying machine 110 are defined by processor 206 under control of control programs stored in memory 208. For the present application, memory 208 may be partially implemented in the form of read-only memory (ROM) and random access memory (RAM). The main control board 200 has a plurality of input/outputs as indicated in FIG. 7. These include inputs from the height scanner 121, transfer plate 122 and transfer plate 124 to receive sensor information. Similarly, the system has an input/output connection to a customer position (not shown in the drawing) which includes a customer ready indication input device 223, activated by the customer, and a system ready signal indicator 224 controlled by the processor 206. The main control board 200 has input/output connections to servomotor indexer 231 from which the processor 206 receives status information and to which high-level language commands, defining motor operational control, are transmitted. The indexer receives commands defining motor parameters such as direction of rotation, distances, speed, acceleration, deceleration, etc. These commands are changed into low-level logic pulses transmitted to servomotor drive control unit 225 which controls operation of motor 170. A motor resolver unit 227 is attached to motor 170 and transmits motor axial position information to indexer 231. A carriage position sensor 229 receives inputs from limit switches 201, 202 (FIG. 3) and transmits state information to indexer 231.

Further inputs to processor 206 are received from a plurality of sensors which includes a bump switch 219 on the head 112 indicating that the head is inappropriately positioned with respect to a product. The processor 206 responds to such an input signal by causing the head 112 to be moved to a higher position and out of the way of the product. A product presence sensor 126 on head 112 indicates when product is in alignment with the head. An air pressure sensor 221, which may be located at any convenient location internal to the label applying machine 110 is connected to the air pressure supply line and provides an indication when air pressure drops below a predetermined value to allow the system to generate an appropriate error indication. Signals from the low label sensor 165 and loop sensor 166 are also provided to the processor 206. An appropriate alerting signal is generated when the low label sensor is activated, and the unwind reel motor to unwind reel 144 by a predetermined distance is initiated when the low loop sensor 166 is active. The control board 200 has input from a zip code input unit 233 which may be located convenient to an operator and which provides zip code data for each label to the processor 206. The zip code data is examined by processor 206 in controlling the printer/applicator head 112, as will be discussed further later herein. A control panel 220 receives status and other signal information from the processor 206 and provides control signals and information such as initialization signals and data and others. The processor 206 communicates zip code information and control information to the printer controller 235. This is a well-known controller which may, for example, be physically located in lower housing 108 and which transmits the necessary control signals to the printer in the printer/applicator head 112 via cabling in E-chain 205. The main control board 200 has a connection to a secondary impresser controller 237, which may be located at any convenient location within the label applying machine 110 and which controls a motor, internal to the head 112, for operating the roller. The roller is turning continually during an operating cycle and its speed is adjusted to be somewhat greater than the speed of the conveyor so as not to interfere with the movement of a product on the conveyor. The processor 206 controls a plurality of solenoids 241 through 246 located at various places within the labeling machine 110. The vacuum shutoff solenoid 241 is operated by main power. Activation of air-blast solenoid 246 reverses vacuum pressure at applicator pad 136 and transfers the label on pad 136 to the product 105. An air-assist solenoid 242 is activated as needed during the operation of the machine. This solenoid applies a relatively low pressure volume of air from an orifice 113 positioned near the terminating end of the peeler bar 152 and assists in transferring a label from the label web 142 onto the applicator pad 136. A main drive brake solenoid 243 activates the brake 182 when required. A pick plate solenoid 244 is activated when the pick plate is to be employed and causes compressed air to be applied to the pneumatic cylinder 133 when the pick plate is to be activated. An unwind drive motor relay 245 is activated when the reel 144 is to be advanced.

Figure 8:
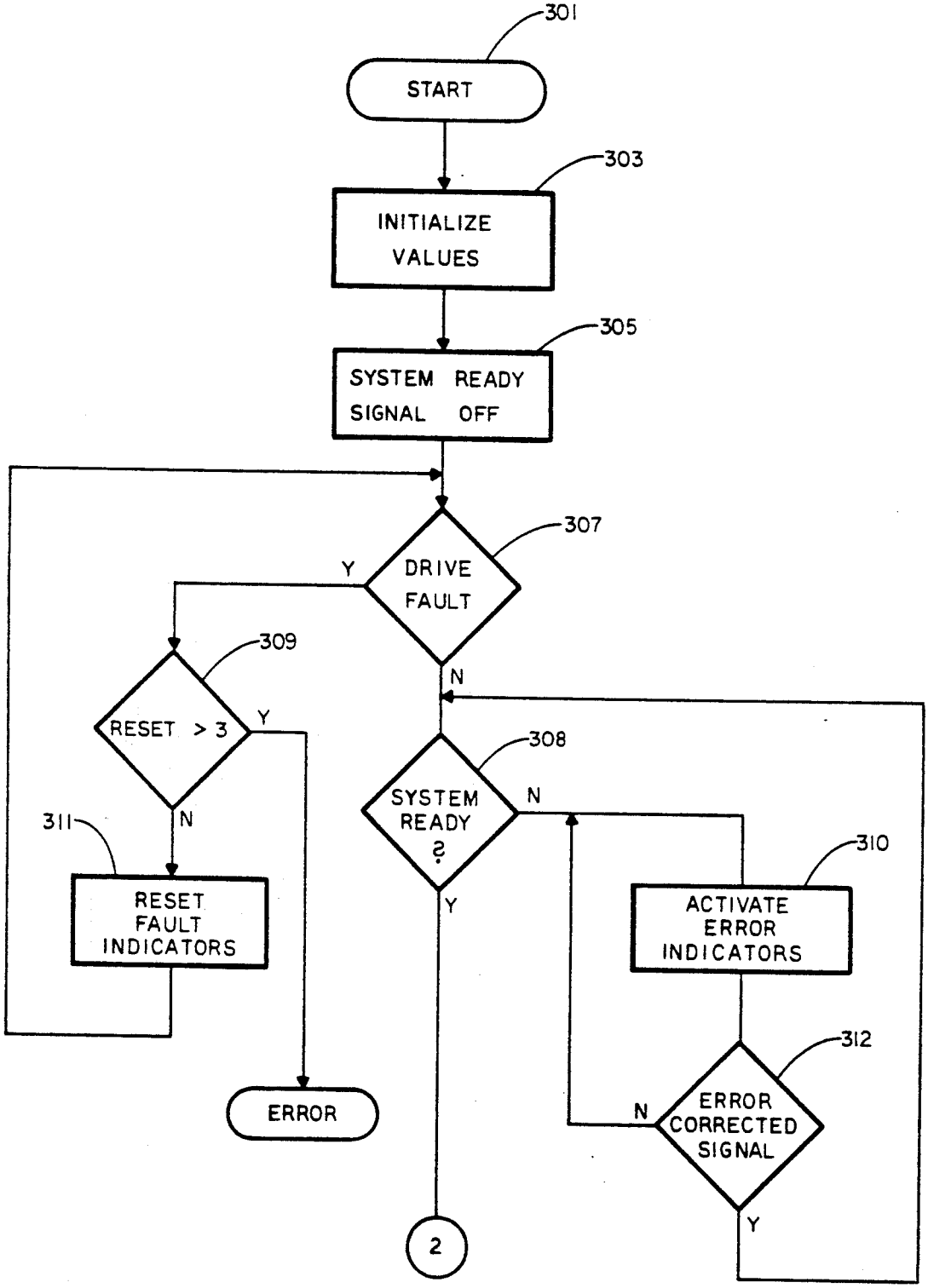
FIGS. 8 through 13 are flow chart representations of functions performed by the control circuitry of FIG. 6.

The functions defined by the control programs are outlined in the flow chart form in FIGS. 8 through 13. With reference to FIG. 8, a start of the program is indicated at block 301. In block 303, certain system values and counters used by the program are initialized. In block 305, a system ready signal 224 is turned off to indicate that the system is not ready for use. Thereafter, a test is made in block 307 to determine whether any fault conditions are indicated for the drive mechanism, which includes the servomotor 170 and drive belt 175 and associated apparatus. Indications as to the status of the drive mechanism are obtained from the servomotor drive control 225 and servomotor indexer 231. If status indications from either of these circuits indicates that there is a drive fault, an advance is made to decision block 309 to determine whether fault indicators have been reset more than three times by this program. If so, an error indication is displayed and the program is halted. If it is determined that the drive fault indicators have not been reset more than three times, an advance is made to block 311 where the fault indicators are reset and a reset count is incremented. Thereafter, the test to determine the existence of a drive fault is again performed in block 307 and if the fault persists, the program will loop until the drive fault has been cleared or the indicators have been reset more than three times. When no drive fault has been found in the test in block 307, and advance is made to block 308 where a "system ready" test is performed. This test includes a check of the bump switch 219, air pressure sensor 221, as well as the product presence sensor 126, the low label sensor 165, the height scanner 121, the transfer plate 122, and transfer plate 124 are examined as well. In addition, the position of a printer-on-line switch in control panel 220 is tested to be sure that the printer has been activated. If any of the sensors or switches are not properly positioned, an error indicator is activated on the control panel 220 as indicated in block 310. In block 312, a test is made to determine whether the error has been corrected and the program will loop until an error corrected signal has been received. Thereafter, the system ready test of block 308 will once again be executed. When the system ready test is passed, an advance is made to block 313 of FIG. 9.

Figure 14:
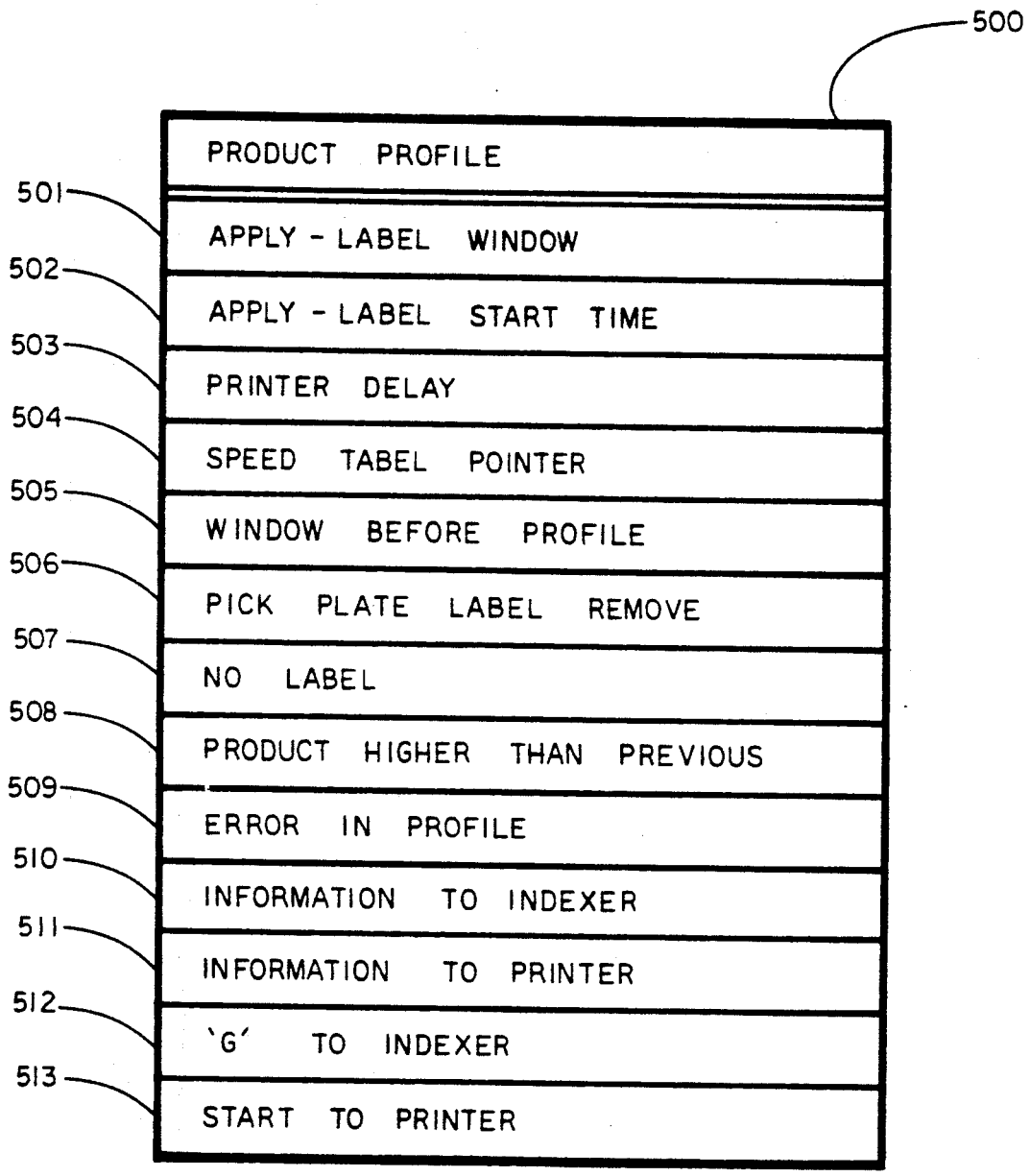
FIG. 14 is a representation of a memory layout for a profile buffer.

In block 313, the servomotor drive control 225 and servomotor indexer 231 are initialized. This initialization involves transmitting signals to these devices to cause the motor 170 to move the carriage 191 to a predetermined home position and thereafter driving the carriage to a maximum height. In block 315 of FIG. 9, the status of a run/load switch in the control panel 220 is tested. If this switch is in the load state, a transfer is made to the label loading program of FIG. 12, as indicated in block 317. If the run/load switch is in the run position, printer buffers, of which one is located in memory 208 and another in the printer controller 235, are cleared, as indicated in block 319. Thereafter, the program waits for a ready signal from the customer ready input 223. As indicated in block 321, the ready signal is continually tested and an advance is made to block 323 when the ready signal is received. In response, the processor 206 transmits an enable signal to the system ready signal 224 at the customer station, as indicated in block 323. In block 325, the processor 206 reads the first of the transfer plates, plate 122, to detect and record product data. The transfer plates and height sensor are commercially available linear sensor arrays having a plurality of aligned individual sensors and typically include circuitry for transmitting data defining which of the individual sensors are illuminated at any one time. The number of sensors used is a function of the desired precision. For example, the height sensor may use an array having sensors at 0.25-inch spacing and the transfer plates may have sensors spaced at 1.5-inch spacing. The height sensor yields height and presence data while the transfer plates yield presence and alignment data, i.e., the lateral position of a product on the conveyor. In block 327 of FIG. 9, the profile buffer is cleared. The profile buffer is stored in an area of memory 208 and contains several items of information of an object, such as the product 105, traveling on the conveyor 101 in the direction of the label applying machine 110. Entries of the profile buffer 500 are shown in FIG. 14 and are discussed further later herein with reference to FIG. 14.

Next, the system looks for the presence of an object, such as product 105 as indicated in block 331. The presence of the product may be detected from data received from the first transfer plate 122. When the product is detected, an advance is made to the profile program as indicated in block 333 of FIG. 10. The profile program computes height and length information of the product on the conveyor, outlined in FIG. 13. Upon completion of this program, an advance is made to decision block 335 of FIG. 10 where a test is made to determine whether a zip code has been received from the zip code input device 233. In this particular exemplary system, it is assumed that a valid zip code will be supplied to the label applying machine 110 for each package or the like to be labeled. A test may be done by the system to determine that the zip code is a valid code, and a check digit may be calculated. If no valid zip code is present, as determined by the test in block 335, an advance is made to block 337 where an error is recorded. Next, an advance is made to block 338 to set a skip-label bit in memory 208 and an advance is made to block 342 to continue with the program. If a valid zip code is present, a zip code check bit may be computed and an advance made to decision block 339. Here a test of the data received from transfer plate 122 is made to ascertain whether the product is properly aligned on the conveyor to be in position for receiving a label. If it is not properly aligned, a transfer is made to block 338 to set the skip-label bit. Otherwise, an advance is made to block 341. Here the zip code is transmitted to printer controller 235 which transmits the data to head 112 for use by its printer unit.

Figure 9:
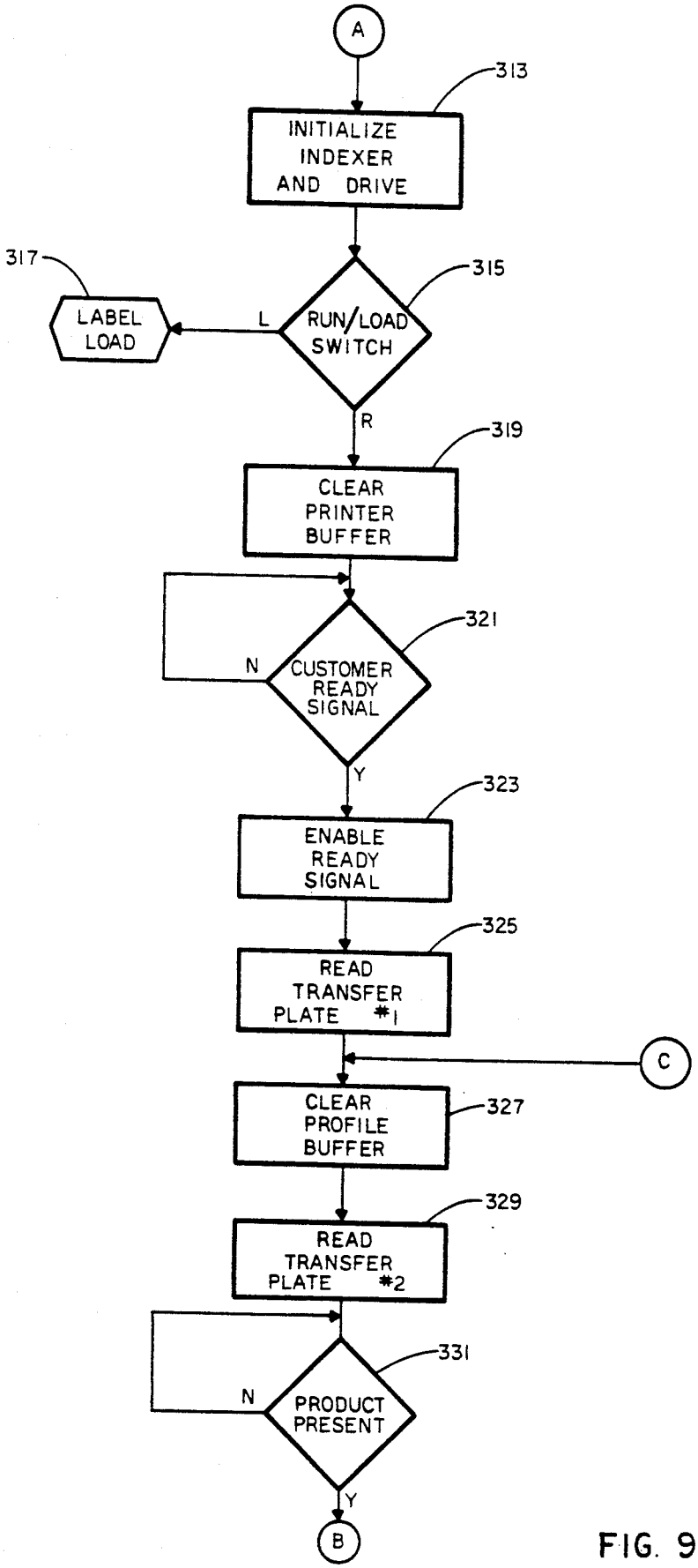
Figure 10:
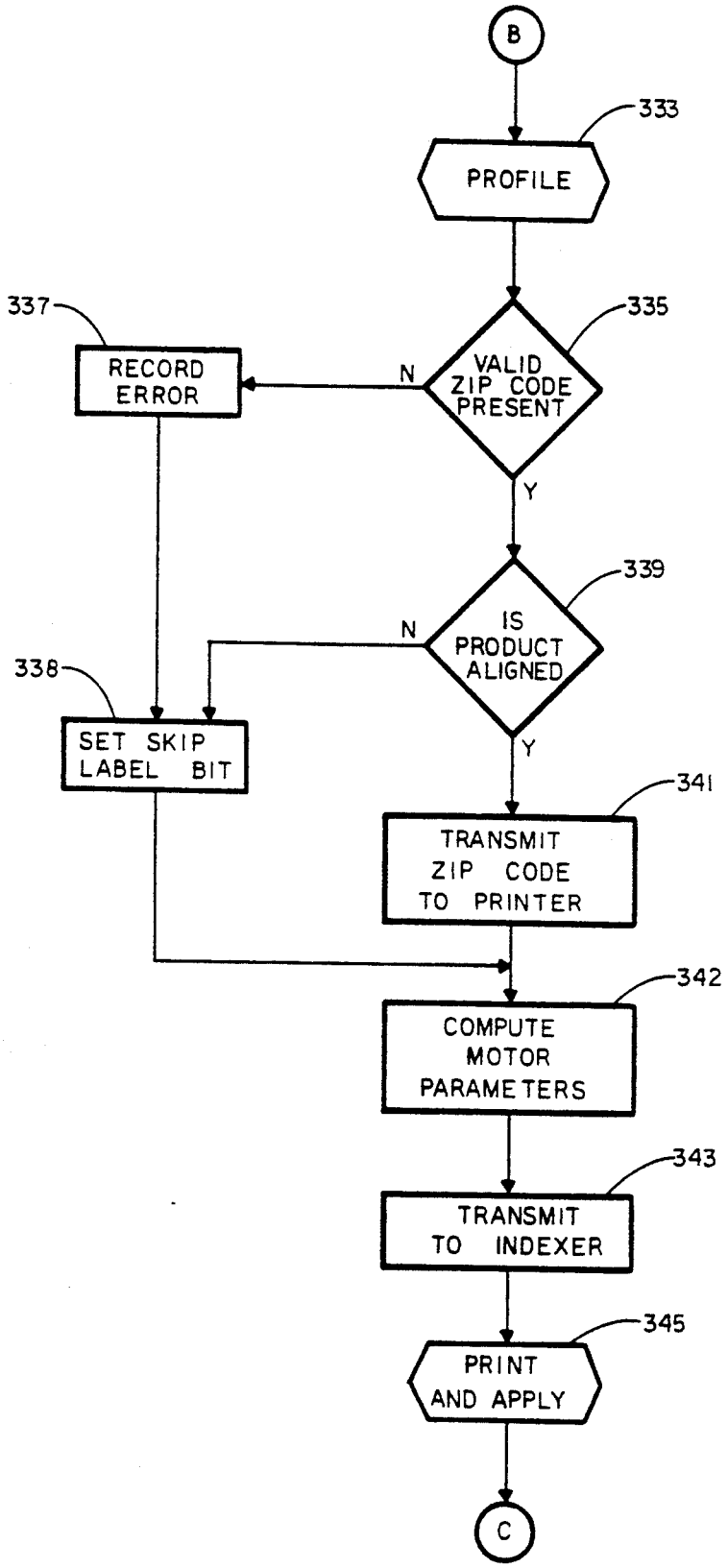

In block 342 of FIG. 10, motor activation parameters are computed and in block 343, specific data generated by processor 206 is transmitted to the indexer 231 to cause the motor to move to a position which corresponds to the height of the package to be labeled. This information includes the direction of movement, acceleration and deceleration rates, distance and speed. The speed at which the printer/applicator head 112 is moved is determined by several factors such as the distance that the head has to be moved, which can be readily computed by recorded height information of the immediately previous product and the present product, and the time available for moving the head. The available time may be readily computed from recorded times at which the last object and the next passed a certain point defined by the transfer plates or the height sensor. At this point in the program, the head 112 is ready to be activated as indicated in block 345 of FIG. 10. Functions associated with that action are controlled by the print and apply program of FIG. 11. Upon completion of that program, a return is made to block 327 of FIG. 9 and preparation for labeling the next product is initiated.

Figure 11:
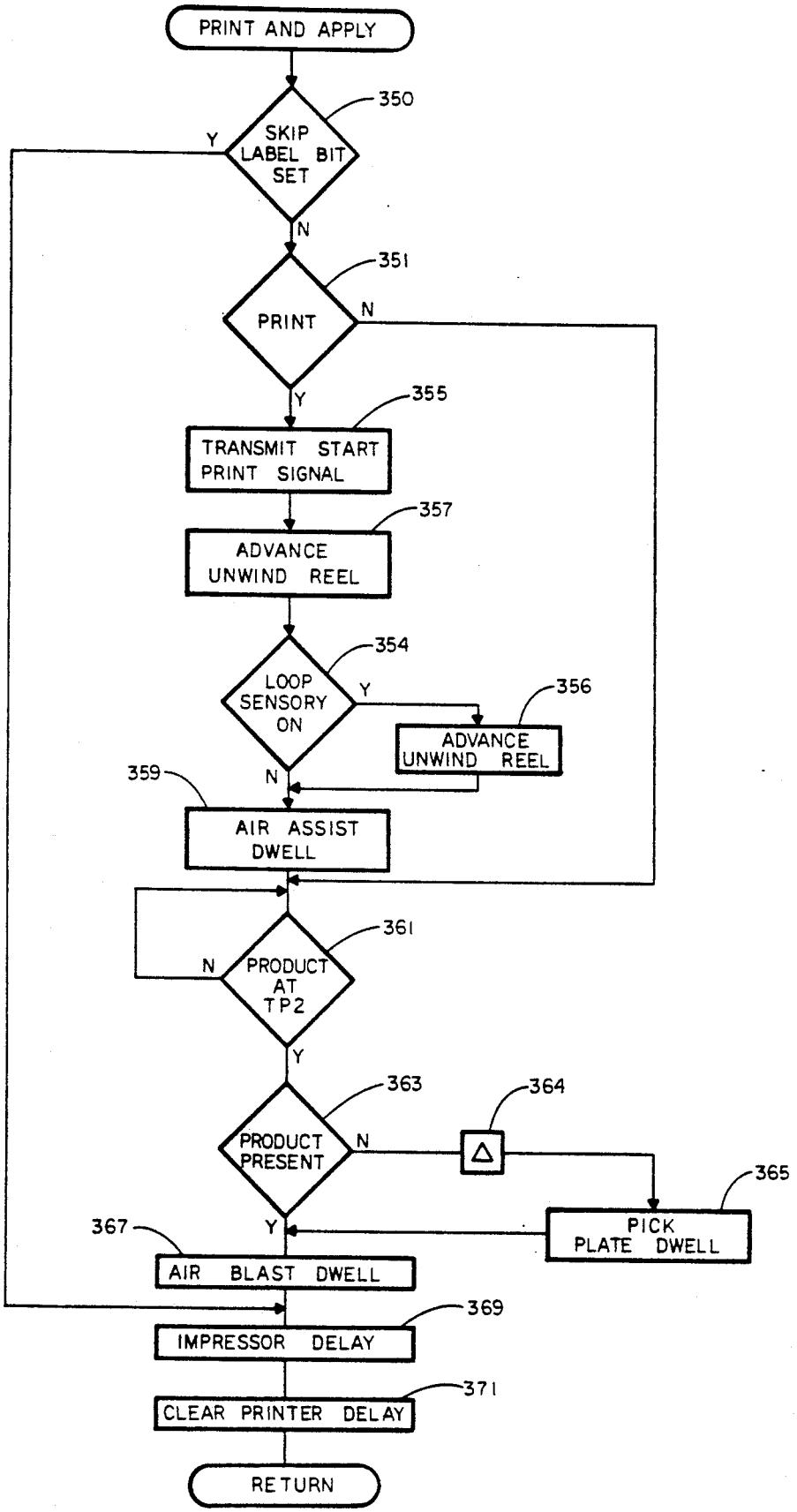

The print and apply program referenced in block 345 of FIG. 9 is outlined in FIG. 11. A test is made in block 350 of FIG. 11 to determine whether the skip-label bit is set. If it is set, an advance is made to block 369 and after delays sufficient to assure that the box has cleared the printer/applicator head 112, a return is made to the main program. Assuming that the label is not to be skipped, a further test is made in decision block 351 to determine whether a label has to be printed. If not, an advance is made to block 361 to continue with the program. When the test in decision block 351 indicates that a label is to be printed, a start print signal is transmitted to the printer/applicator head 112 as indicated in block 355. Furthermore, the unwind reel 144 is advanced by activating an unwind drive motor relay 245. The amount by which the reel is to be advanced is controlled by activation time of the relay. As indicated earlier herein, the reel may be advanced a distance slightly less than the full length of a label in order to assure that the loop section 145 of the web 142 is not unduly lengthened. In block 354, a test is made of the loop sensor 166. If it is activated, the motor relay 245 is activated for twice the period of the earlier activation, to extend loop 145 by a predetermined amount. From block 354 or 356, an advance is made to block 359 where the air-assist dwell or delay period is invoked, and the air-assist solenoid 242 is operated for a predetermined period of time.

Thereafter, an advance is made to decision block 361 where a test is made to determine whether the product has arrived at the second transfer plate 124, which is positioned in close proximity of the label applying machine 110. When the product is detected at transfer plate 124, a window to detect the product at the product presence detector 126 on head 112 is initiated. If the product is not detected at the product presence indicator after a prescribed delay as indicated in block 364, it is assumed that the product has been missed, and the label which is ready to be applied to a product has to be removed from the applicator pad 136. For that reason, the pick plate dwell or delay is activated as indicated in box 365. This will cause the pick plate solenoid 244 to be operated for a prescribed period of time defined by system parameters, causing the pick plate 134 to be moved into position in alignment with the applicator pad 136. Thereafter, as indicated in block 367, the air-blast dwell is initiated causing the air-blast solenoid 246 to be activated for a prescribed period of time. The pick plate dwell exceeds the air-blast dwell by a sufficient amount of time to assure that the pick plate is in place when the air blast is actuated. At the termination of the air-blast dwell, the air-blast solenoid 246 will be deactivated and thereafter the pick plate solenoid 244 will be deactivated causing the pick plate 134 to be removed to its retracted position.

If in the test of decision block 363 it is found that the product is present, the air-blast dwell will be activated, operating air-blast solenoid 244, to cause the label to be transferred to the product by a blast of air. The secondary impresser roller 130 serves to further apply the label to the product, and in block 369 a delay is introduced sufficient to assure that the printer/applicator head 112 is not moved until after the impresser roller has passed over label. The impresser delay may be readily computed as a function of the speed of the conveyor and may be defined at the time of initialization as a system parameter. A further delay, referred to as the clear printer delay, is introduced in block 371. This delay may be defined as a system parameter or may be computed with respect to the length of the product being labeled and the speed of the conveyor. The length of the product may be readily calculated with reference to the transfer plates 122, 124 or to the height sensor 121. The reason for the clear-printer delay is to assure that the head 112 is not moved downward until the product has cleared, since such movement could damage both the product and the machine. If desired, the head may be moved up after the impresser delay of block 369.

Figure 12:
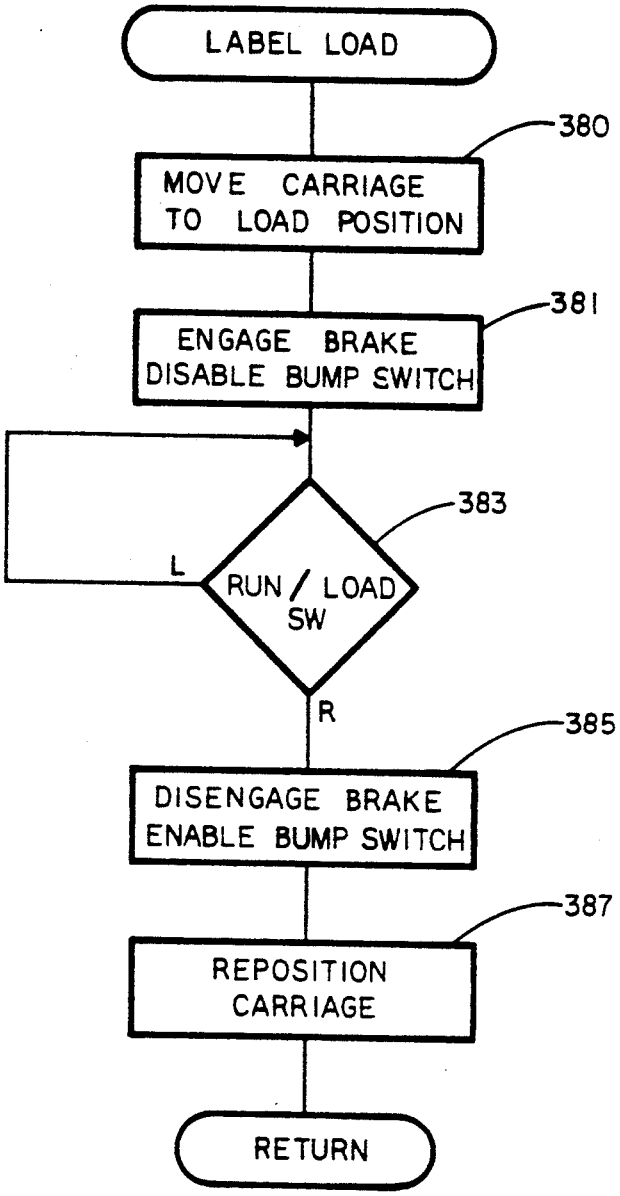

The label loading program referenced in block 317 of FIG. 9 is shown in further detail in FIG. 12. Upon entry on the program, the carriage 191 is moved to a predetermined load position which may be any convenient location, for example, at the home position of the carriage 191. This is accomplished by sending an appropriate signal to the servomotor indexer 231 to rotate the motor and to cause the carriage 191 to be moved to a predetermined position. This function is indicated in block 380 of FIG. 11. In block 381, the main drive brake 182 is applied by operating the main drive solenoid 243. Furthermore, the bump switch 219 is disabled to prevent inadvertent activation of the head 112. Thereafter, an advance is made to decision block 383 while new labels are being loaded in the equipment by service personnel. The state of the run/load switch, which is controlled by the service personnel, is examined periodically. When that switch is moved to the run position, an advance is made to block 385 where the main drive brake 182 is disengaged by deactivating the main drive brake solenoid 243 and bump switch 219 is enabled. Thereafter, an advance is made to block 387 and the carriage is repositioned to the maximum height position. Thereafter, a return is made to the main program.

Figure 13:
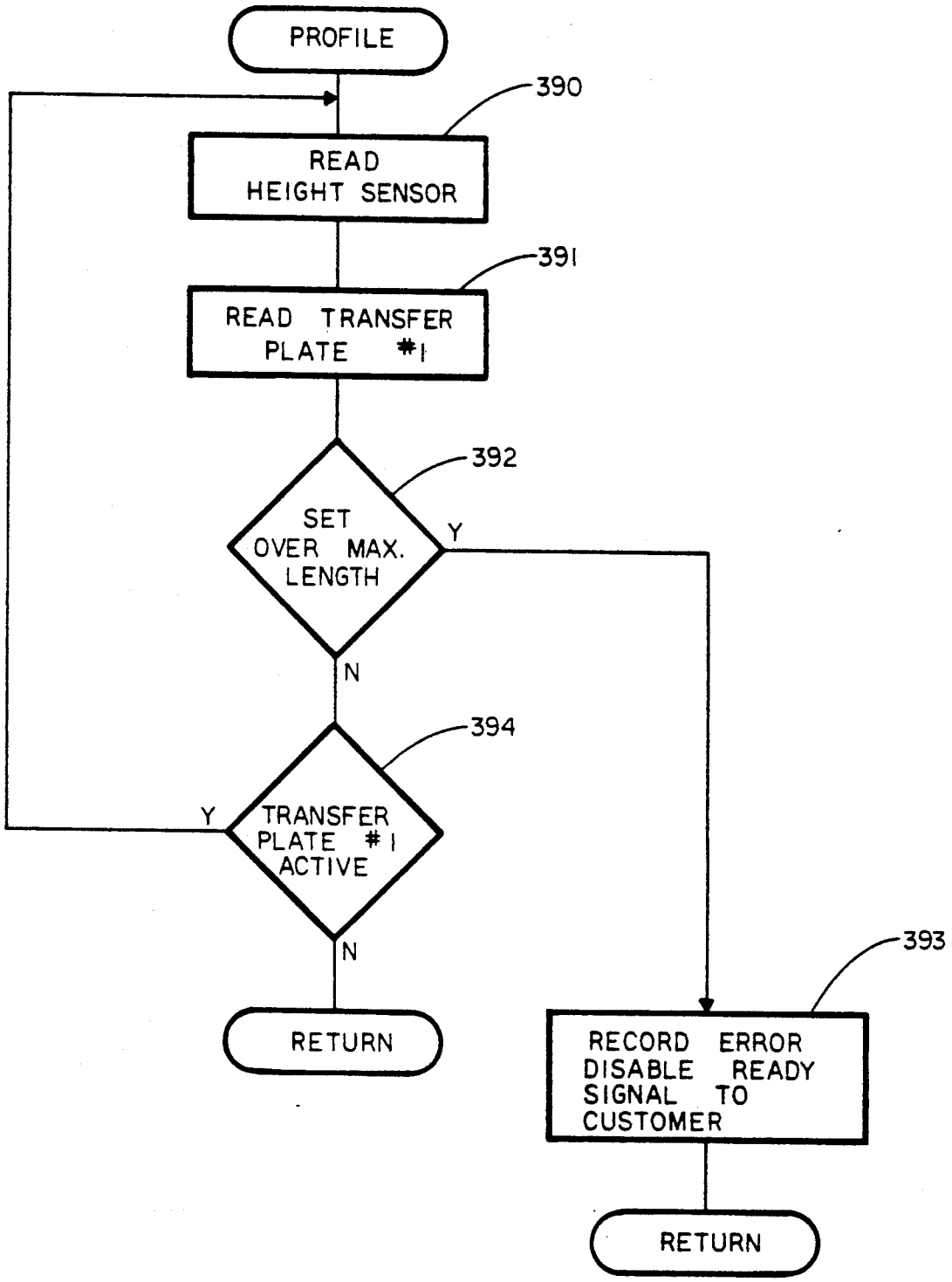

The profile program referenced in block 333 of FIG. 10 is shown in greater detail in block diagram form in FIG. 13. The function of profiling includes the step of reading the height sensor 121. Height sensor 121 comprises a vertically extending array of photodetectors and logic circuitry associated with the array typically indicates the position above which the object being scanned does not extend. As indicated in block 390 of FIG. 13, the system reads the height sensor 121 and, as indicated in block 391 of FIG. 13, also reads the state of the first transfer plate 122. By recording the times at which sensors 121, 122 are activated and deactivated, the length of the passing object may be readily calculated. A test is made in decision block 392 of FIG. 13 to determine whether a predetermined length parameter has been exceeded. If so, an advance is made to error block 393. As indicated in block 393, an error is recorded, the system ready signal 224 at the customer position is disabled, and a return is made to the main program, for example, at block 321 of FIG. 9. If it is determined in decision block 392 that the object is not over a maximum length, a test is made in decision block 394 to determine whether the first transfer plate 122 is still active. If the first transfer plate 122 is still active, this is an indication that the object has not yet completely passed over that detector and the program will continue to perform maximum length calculations until the trailing edge of the object has passed over the first transfer plate or the maximum length parameter has been exceeded.

FIG. 14 is a representation of a profile buffer 500 in which is recorded information with respect to a product as it is processed. The data in the buffer is entered during processing of a product and may be recorded for later use by the labeling program or for diagnostic or record-keeping purposes. The first entry, entry 501, is the apply-label window which defines the window during which the product presence sensor 126 is enabled to determine the presence of a product as, for example, in decision block 363 of FIG. 11. Entry 502 is the start time of the window of entry 501 and corresponds to the time of detection of a product at transfer plate 2 as indicated in block 361 of FIG. 11. Entry 503 is the printer delay used in block 371 of FIG. 11 and is derived from product length and line speed information. Entry 504 is a window-before-profile entry which specifies the time between products as determined from data from one of the transfer plates. The entry 505 is a speed table pointer and refers to the speed group used to determine the speed at which the printer/applicator head must move. A convenient way to obtain control information to be transmitted to the servomotor indexer 231 is by means of the speed table. Entry into the table is derived from the window-before-profile information. The speed table provides the commands to be transmitted to the indexer 231 which define the speed at which the motor has to be turned in order to properly move the head 112 to its next position before arrival of the next product. Entry 506 represents a bit that is set if a label has already been printed and the product is not detected during the apply-label window. In that case, the label will be removed by actuating the pick plate as described earlier with respect to FIG. 11. Entry 507 represents a bit that is set in case a label was not applied because a valid zip code was not received or the product was not aligned on the conveyor in a position to receive a label, as described earlier with respect to FIG. 10. Entry 508 is a bit that is set if the product is higher than the last previous product. Reference to this bit allows the printer/applicator head 112 to move to the next position after the label impresser delay shown in block 369 of FIG. 11. Entry 509 is a record of an error detected by the profile program of FIG. 13. Entries 510 and 511 are bits indicating that information has been sent to the indexer 231 and printer controller 235, respectively. Entries 512 an 513 are bits indicating that start signals have been sent to the indexer 231 and printer controller 235, respectively.

It will be understood that the embodiments described herein are only illustrative of the invention and that numerous variations thereof can be derived by those skilled in the art without departing from the spirit and scope of the invention.

What is claimed is:

1. Apparatus for labeling objects of differing dimensions moving relative to the apparatus and adjacent thereto, comprising:

a stationary support structure;

a label applicator head movably supported on said support structure;

a drive mechanism for moving said head along a predefined path of travel; and control circuitry responsive to an input signal indicative of a size dimension of an object to selectively control said drive mechanism to move said head from a first position corresponding to a size dimension of a first object to a second position corresponding to a size dimension of a second object along a shortest path between said first and said second positions.

2. The apparatus in accordance with claim 1 and further comprising a guide bar mounted on said support structure and a carriage supporting said head and slidably engaging said guide bar and a drive mechanism comprising an electric motor having a drive shaft and drive wheel attached thereto, and an interconnecting member interconnecting said drive wheel and said carriage for causing said carriage to be moved along said guide bar in correspondence with rotation of said drive wheel.

3. The apparatus in accordance with claim 2 and further comprising an idler pulley and wherein said interconnecting member comprises a belt engaging said carriage, said drive wheel, and said idler pulley.

4. The apparatus in accordance with claim 3 wherein said belt comprises a ribbed inner surface and said drive wheel comprises a ribbed surface for positive engagement with said belt.

5. The apparatus in accordance with claim 4 and further comprising a tensioner pulley engaging said belt for selective adjustment of tension of said belt.

6. The apparatus of claim 2 wherein said guide bar comprises a pair of parallel guide rods and said carriage slidably engages both of said guide rods and said drive mechanism.

7. The apparatus in accordance with claim 6 comprising an electrical limit switch at each end of said guide bar for generating an output signal when engaged by said carriage.

8. Apparatus for labeling objects of differing dimensions moving relative to the apparatus and adjacent thereto, comprising:

a stationary support structure;

a label applicator head movably supported on said support structure;

a drive mechanism for moving said head along a predefined path of travel; and control circuitry responsive to an input signal indicative of a size of an object and control signals representative of distance of an approaching object from said head and signals representative of speed of travel of an object in the direction of said head to move said head at a rate of travel which is derived as a function of said signals representing distance and speed of travel of said object.

9. The apparatus in accordance with claim 8 wherein said drive mechanism includes a variable speed control motor and said control circuitry includes a control processor responsive to said signals representing said distance, speed of travel and said size dimension to transmit to said motor an output signal defining magnitude, direction, and rate of rotation for said motor.

10. The apparatus in accordance with claim 1 wherein said apparatus further comprises a storage reel mounted on said support structure and having stored thereon a continuous elongated strip and labels adhesively attached to said strip and wherein said strip extends from said reel to said movable head, said head comprising a label separating mechanism and a label application device responsive to activation control signals to deposit a label on an object, said apparatus further comprising an alignment sensing device for generating an output signal when an object is in alignment with said head and said control circuitry is responsive to said alignment signal for generating said application control signal.

11. The apparatus in accordance with claim 10 wherein said label application device comprises a porous grid and wherein a label is retained against one side of said grid by air pressure lower than atmospheric pressure on the other side of said grid and said label is applied to an object by air pressure greater than atmospheric pressure on said other side of said grid and wherein the application of air pressures below and above atmospheric pressure are applied by means of control solenoids and wherein said control circuitry operates said control solenoids in response to said alignment control signal.

12. The apparatus in accordance with claim 11 wherein said head comprises a support arm connected to said carriage and at least one of said control solenoids is supported by said support arm.

13. The apparatus in accordance with claim 1 and further comprising a storage reel mounted on said stationary support structure for storing a continuous label supply strip extending from said reel to said head, said head comprising a label peeling device for peeling a label from said strip and a label applicator for applying a label onto an object and further comprising a label receiving assembly comprising a plate selectively positionable in alignment with said applicator to receive a label from said applicator, said assembly further comprising an extension arm on said plate pivotally attached to said head and an actuator attached to said head for moving said plate between one position in alignment with said applicator and another position away from said applicator and along one side of said head, whereby said plate is removed from a path of travel of any object when in a retracted position.

14. The apparatus in accordance with claim 13 wherein said actuator comprises a pneumatic cylinder and actuation of said cylinder is controlled by said control circuit.

15. The apparatus in accordance with claim 14 wherein said cylinder has one end pivotally attached to said head and another end pivotally attached to said plate.

16. The apparatus in accordance with claim 13 wherein said head further comprises an alignment sensor for generating an alignment signal when an object is in alignment with said head and said control circuitry controls said plate assembly to move said plate to said one position for receiving a label when no alignment signal is received during a predetermined time period.

17. The apparatus in accordance with claim 1 and further comprising a label supply reel mounted on said stationary support structure and a continuous label supply strip stored on said reel, a label removing device on said head, said label supply strip extending from said reel to said label removing device, said reel responsive to control signals to unwind said strip from said reel, said control circuitry generating a control signal to unwind said strip from said reel by a length of said strip less than a standard label length each time a label is removed from said strip.

18. The apparatus in accordance with claim 17 and further comprising a label strip position sensor for generating a predetermined signal when a length of said strip extending between said reel and said head is less than a predetermined amount and said control circuitry responsive to said predetermined signal to advance said reel by a selected amount.

19. The apparatus in accordance with claim 1 wherein said head comprises a label applicator device for transferring a preprinted label to an object and said head further comprises an impresser roller disposed adjacent said label applicator for further forcing a label onto an object after a label has been applied by said applicator.

20. The apparatus in accordance with claim 1 wherein the applicator head comprises a bump switch along a lower side of the applicator head and which is responsive to contact with an object having a surface higher than a lower part of the applicator head to generate a warning output signal and wherein the control circuitry is responsive to the warning output signal to control the head to be moved to a relatively higher position.

21. In a labeling system comprising a continuous motion conveyor and a labeling machine having a vertically movable applicator head, a method of labeling objects comprising the steps of:

detecting the height of a moving object traveling toward the head and relative position of the object with respect to the head;

prior to arrival of the object in a position in vertical alignment with the head, computing required vertical distance and direction of movement of the head for proper horizontal alignment with an upper surface of the object;

computing the minimum rate of travel at which the head has to be moved from a current position to a position in proper horizontal alignment with respect to the upper surface of the object when the object reaches a position of vertical alignment with the head;

moving the applicator head to a next selected position at the computed rate of travel; and controlling the head to apply a label to the object.

22. The claim in accordance with claim 21 wherein the step of applying the label includes the step of detecting the presence of the object prior to applying the label.

23. The method in accordance with claim 21 and further comprising the step of delaying movement of the head after application of a label by a time period sufficient to assure movement of the object past the head before moving the head toward a position occupied by the object in the step of controlling the head to apply a label to the object.

24. The method in accordance with claim 21 in a system further comprising a label supply reel and an elongated label strip stored thereon and extending between the reel and the applicator head, the step of unwinding the reel by a distance less than a label length each time a label is removed at the applicator head and the step of unwinding the reel an additional amount when a length of labeling strip between the reel and the applicator head becomes shorter than a predetermined length.

25. The method in accordance with claim 21 in a system comprising an impresser roller on said head further comprising the step of delaying movement of the head after application of a label by a time period sufficient to assure application of said impresser roller before moving said head.

26. Apparatus for labeling objects of differing dimensions moved toward a position adjacent said apparatus at a predetermined speed along a conveying member extending in a predefined plane, comprising:

a stationary support structure adjacent said conveying member;

a label applicator head supported on said support structure and movable in a direction perpendicular to said predefined plane for applying labels to an object to be labeled when said object is in a position of alignment with said head in said perpendicular direction;

control circuitry including an electric motor connected to said head and responsive to an input signal defining a size dimension extending in said perpendicular direction of an object to be labeled to move said head from a first position corresponding to a size dimension of a first object to a second position corresponding to a size dimension of a second object along a shortest path between said first and said second positions.

27. The apparatus in accordance with claim 1 and further comprising a height sensor disposed a predetermined distance from said head, said sensor responsive to the presence of an object of a defined height disposed adjacent said sensor to transmit said input signal to said control circuitry defining the height of said object adjacent said sensor.

28. The apparatus in accordance with claim 1 and further comprising a plurality of spaced apart presence sensors transmitting to said control circuitry approach signals indicative of the presence of an object approaching said head and wherein said control circuitry is responsive to said approach signals to move said head to said second position at a computed rate of speed derived from said approach signals.

29. The apparatus in accordance with claim 26 wherein said control circuitry is responsive to control signals representative of speed of an approaching object to move said head at a rate of travel which is derived as a function of said control signals representative of speed of said approaching object.

* * * * *